US005878753A

United States Patent [19]

Peterson et al.

[11] Patent Number: 5,878,753

[45] Date of Patent: Mar. 9, 1999

[54] SMOKING ARTICLE WRAPPER FOR CONTROLLING IGNITION PROCLIVITY OF A SMOKING ARTICLE WITHOUT AFFECTING SMOKING CHARACTERISTICS

[75] Inventors: Richard M. Peterson, Marietta, Ga.; Joseph S. Kucherovsky, Philadelphia, Pa.

[73] Assignee: Schweitzer-Mauduit International, Inc., Alpharetta, Ga.

[21] Appl. No.: 815,434

[22] Filed: Mar. 11, 1997

[51] Int. Cl.[6] ..... A24D 1/02

[52] U.S. Cl. ..... 131/365; 131/349; 131/336

[58] Field of Search ..... 131/365, 349, 131/336

[56] References Cited

U.S. PATENT DOCUMENTS

| | | |
|---|---|---|
| 218,389 | 8/1879 | Lucas . |
| 225,858 | 3/1880 | O'Connor . |
| 625,293 | 5/1899 | Doutney . |
| 671,548 | 4/1901 | Gordon . |
| 1,555,320 | 9/1925 | Weil . |
| 1,581,451 | 4/1926 | Knapp . |
| 1,605,059 | 11/1926 | Oakes et al. . |
| 1,666,062 | 4/1928 | Alexander . |
| 1,726,737 | 9/1929 | Harris . |
| 1,744,615 | 1/1930 | Crosthwait . |
| 1,770,616 | 7/1930 | Kean . |
| 1,798,537 | 3/1931 | Honigbaum . |
| 1,862,679 | 6/1932 | Holsman . |
| 1,863,000 | 6/1932 | Barnes . |
| 1,879,128 | 9/1932 | Desper . |
| 1,905,416 | 4/1933 | Low . |
| 1,996,002 | 3/1935 | Seaman . |
| 1,999,222 | 4/1935 | Weinberger . |
| 2,013,508 | 9/1935 | Seaman . |
| 2,028,552 | 1/1936 | Low . |
| 2,049,320 | 7/1936 | Ruben et al. . |
| 2,098,619 | 11/1937 | Finnell . |
| 2,147,889 | 2/1939 | Gardiner . |
| 2,185,293 | 1/1940 | Copeman . |
| 2,246,929 | 6/1941 | Seney . |
| 2,307,088 | 1/1943 | Whiteley . |
| 2,327,991 | 8/1943 | Betts . |
| 2,329,927 | 9/1943 | Morton . |
| 2,547,119 | 4/1951 | Henderson . |
| 2,666,437 | 1/1954 | Lattof . |
| 2,682,270 | 6/1954 | Schur . |
| 2,718,889 | 9/1955 | Claussen . |
| 2,746,890 | 5/1956 | Legler . |
| 2,754,828 | 7/1956 | Swain . |
| 2,775,970 | 1/1957 | Schoenbaum . |
| 2,890,704 | 6/1959 | Lamm . |
| 2,976,190 | 3/1961 | Meyer . |
| 2,985,175 | 5/1961 | Rich . |
| 2,992,647 | 7/1961 | Figge . |
| 2,998,012 | 8/1961 | Lamm . |
| 3,030,963 | 4/1962 | Cohn . |
| 3,081,776 | 3/1963 | Park . |
| 3,091,243 | 5/1963 | Guida . |
| 3,102,543 | 9/1963 | O'Siel et al. . |
| 3,165,105 | 1/1965 | Campbell . |
| 3,220,418 | 11/1965 | Cohn . |
| 3,228,402 | 1/1966 | Lebert . |
| 3,276,453 | 10/1966 | Corley . |
| 3,285,253 | 11/1966 | Lebert . |
| 3,288,145 | 11/1966 | Rosentahal . |
| 3,349,776 | 10/1967 | Bell et al. . |
| 3,370,593 | 2/1968 | Owaki . |
| 3,528,432 | 9/1970 | Stossel . |
| 3,632,384 | 1/1972 | Saint-Pastou . |
| 3,702,117 | 11/1972 | Borthwick . |
| 3,736,940 | 6/1973 | Saint-Pastou . |
| 3,903,899 | 9/1975 | Musillo ..... 131/15 R |
| 3,977,416 | 8/1976 | Akiba . |
| 3,985,143 | 10/1976 | Lappin, Jr. . |
| 4,044,778 | 8/1977 | Cohn . |
| 4,061,147 | 12/1977 | Falchi . |
| 4,077,414 | 3/1978 | Baker et al. . |
| 4,091,821 | 5/1978 | Scorzo . |
| 4,121,597 | 10/1978 | Shin . |
| 4,146,040 | 3/1979 | Cohn . |
| 4,226,249 | 10/1980 | Newman . |
| 4,230,131 | 10/1980 | Simon . |
| 4,231,377 | 11/1980 | Cline et al. . |
| 4,236,532 | 12/1980 | Schweizer et al. . |
| 4,243,053 | 1/1981 | Cartwright et al. . |
| 4,303,084 | 12/1981 | Simon . |
| 4,407,308 | 10/1983 | Baker et al. . |
| 4,420,002 | 12/1983 | Cline . |
| 4,436,101 | 3/1984 | Seatts . |

| | | | |
|---|---|---|---|
| 4,450,847 | 5/1984 | Owens . | |
| 4,452,259 | 6/1984 | Norman et al. . | |
| 4,453,553 | 6/1984 | Cohn . | |
| 4,461,311 | 7/1984 | Mathews et al. . | |
| 4,480,650 | 11/1984 | Weinert . | |
| 4,489,738 | 12/1984 | Simon . | |
| 4,607,647 | 8/1986 | Dashley et al. . | |
| 4,615,345 | 10/1986 | Durocher . | |
| 4,622,983 | 11/1986 | Mathews et al. . | |
| 4,624,268 | 11/1986 | Baker et al. . | |
| 4,643,205 | 2/1987 | Redding et al. . | |
| 4,739,775 | 4/1988 | Hampl, Jr. | 131/365 |
| 4,805,644 | 2/1989 | Hampl, Jr. et al. . | |
| 4,889,145 | 12/1989 | Adams et al. . | |
| 4,909,854 | 3/1990 | Light et al. . | |
| 4,945,932 | 8/1990 | Mentzel et al. . | |
| 5,057,158 | 10/1991 | Rohr et al. . | |
| 5,060,675 | 10/1991 | Milford et al. . | |
| 5,103,844 | 4/1992 | Hayden et al. . | |
| 5,120,368 | 6/1992 | Houminer et al. . | |
| 5,129,954 | 7/1992 | Chan et al. . | |
| 5,161,550 | 11/1992 | Owens, Jr. . | |
| 5,271,419 | 12/1993 | Arzonico et al. . | |

FOREIGN PATENT DOCUMENTS

| | | |
|---|---|---|
| 175148 | 6/1953 | Australia . |
| 265901 | 5/1960 | Australia . |
| 537531 | 2/1955 | Belgium . |
| 659839 | 3/1965 | Belgium . |
| 175005 | 3/1917 | Canada . |
| 496123 | 9/1953 | Canada . |
| 694631 | 9/1964 | Canada . |
| 835684 | 3/1970 | Canada . |
| 281967A | 9/1988 | European Pat. Off. . |
| 483998A | 5/1992 | European Pat. Off. . |
| 486213A1 | 5/1992 | European Pat. Off. . |
| 0559300A2 | 9/1993 | European Pat. Off. . |
| 1040981 | 3/1953 | France . |
| 1517262 | 3/1968 | France . |
| 1560360 | 3/1969 | France . |
| 2556184A | 6/1985 | France . |
| 549936 | 5/1932 | Germany . |
| 608407 | 1/1935 | Germany . |
| 613294 | 5/1935 | Germany . |
| 146513 | 7/1936 | Germany . |
| 1959684 | 6/1971 | Germany . |
| 2206185 | 8/1972 | Germany . |
| 2120586 | 11/1972 | Germany . |
| 2162168 | 7/1973 | Germany . |
| 2308658 | 8/1974 | Germany . |
| 2308667 | 9/1974 | Germany . |
| 2444929 | 4/1975 | Germany . |
| 2537334 | 3/1976 | Germany . |
| 2906417 | 8/1980 | Germany . |
| 3741008A | 6/1988 | Germany . |
| 4202750A1 | 8/1993 | Germany . |
| 317118 | 4/1933 | Italy . |
| 54-052686 | 4/1979 | Japan . |
| 48468 | 6/1909 | Switzerland . |
| 142429 | 11/1930 | Switzerland . |
| 240987 | 6/1946 | Switzerland . |
| 622411 | 4/1981 | Switzerland . |
| 14494 | 11/1884 | United Kingdom . |
| 264045 | 1/1927 | United Kingdom . |
| 528190 | 10/1940 | United Kingdom . |
| 646020 | 11/1950 | United Kingdom . |
| 672298 | 5/1952 | United Kingdom . |
| 760772 | 3/1956 | United Kingdom . |
| 835923 | 2/1960 | United Kingdom . |
| 933161 | 8/1963 | United Kingdom . |
| 1056941 | 2/1967 | United Kingdom . |
| 1214319 | 12/1970 | United Kingdom . |
| 1436073 | 5/1976 | United Kingdom . |
| 2020535 | 11/1979 | United Kingdom . |
| 2025753 | 1/1980 | United Kingdom . |
| 2145919 | 4/1985 | United Kingdom . |
| 8601377 | 3/1986 | WIPO . |
| 8606591 | 11/1986 | WIPO . |

OTHER PUBLICATIONS

"New Process fire–proofs cigarettes", Tobacco, pp. 12, 14, Jan. 21, 1997.

*Primary Examiner*—John G. Weiss
*Assistant Examiner*—Charles W. Anderson
*Attorney, Agent, or Firm*—Dority & Manning, P.A.

[57] ABSTRACT

A smoking article wrapper has discrete areas of reduced permeability for improving ignition proclivity characteristics of a smoking article. The reduced permeability areas define a gradually decreasing permeability profile in a burning direction of the smoking article such that permeability reduction in the reduced permeability areas increases from a minimum reduction to a maximum permeability reduction in the burning direction of the smoking article.

25 Claims, 3 Drawing Sheets

SMOKING ARTICLE WRAPPER FOR CONTROLLING IGNITION PROCLIVITY OF A SMOKING ARTICLE WITHOUT AFFECTING SMOKING CHARACTERISTICS

BACKGROUND OF THE INVENTION

The present invention relates to a smoking article wrapper composition, and a method of making the smoking article wrapper composition, for significantly reducing ignition proclivity of the smoking article without adversely affecting smoking characteristics. The invention particularly relates to an improved wrapper paper for cigarettes wherein treated bands on the cigarette wrapper tend to cause the cigarette to self-extinguish if left or dropped on a substrate before igniting the substrate.

There is an ongoing concern in the industry to produce cigarettes having wrappers which reduce the ignition proclivity of the smoking article, or the tendency of the smoking article to ignite surfaces which come into contact with the lit smoking article. Reports have been made of fires attributed to burning cigarettes coming into contact with combustible materials. A justifiable interest exists in the industry to reduce the tendency of cigarettes, or other smoking articles, to ignite surfaces and materials used in furniture, bedding, and the like upon contact.

Thus, a desirable feature of smoking articles, particularly cigarettes, is that they self-extinguish upon being dropped or left in a free burning state on combustible materials.

It has long been recognized in the industry that the cigarette wrapper has a significant influence on the smolder characteristics of the cigarette. In this regard, various attempts have been made in the art to alter or modify the cigarette wrappers in order to achieve the desired tendency of the cigarette to self extinguish, or in other words to reduce the ignition proclivity characteristics of cigarettes. Prior references describe the application of fibrous slurries and/or film-forming solutions to cigarette paper to reduce permeability and control burn rate. It has been shown that when these materials have been applied in discrete bands around the circumference of the cigarette, the cigarette shows a reduced propensity to ignite a substrate and has an increased puff count.

For example, it is known from U.S. Pat. No. 4,452,259 to define at least one circumferential band on the wrapper of a smoking article which will hopefully cause the smoking article to extinguish under free burn conditions. The band is formed by applying a liquid substance or compound to the cigarette paper which has a liquid form in a temperature range of about 100° C. to 200° C. This reference teaches that, as the burning cone of the cigarette comes into contact with the band, the compound forms a liquid film on the cigarette paper which substantially restricts the flow of air to the burning coal.

U.S. Pat. No. 4,945,932 teaches another method of providing areas of decreased air permeability which cause the cigarette to self extinguish as the cigarette smolders or burns into the area of reduced permeability. The '932 patent teaches to form patterned or annular zones in the cigarette paper by multiple batonneing of the paper, for example, by use of an embossing calendar.

U.S. Pat. No. 4,077,414 discloses the use of printed bands of material on cigarette paper to control the burn rate of the cigarette. Although this reference does not particularly address ignition proclivity, it teaches to provide relatively narrow low porosity bands along the cigarette. The bands are formed by applying a gel-forming substance to the paper by painting, printing, or other coating techniques. The reference teaches that preferred gel-forming substances are those which form gels in water, such as gelatin, alginates, methyl cellulose, methylethyl cellulose and gums. Water insoluble substances such as lacquers and varnishes may also be used in an organic solvent.

U.S. Pat. No. 4,889,145 is another reference that teaches of providing areas of reduced porosity along the cigarette by applying a discontinuous coating of a porosity reducing composition. This reference is not particularly concerned with ignition proclivity of the smoking article, but with controlling the puff count and tar delivery of the smoking article. This reference also teaches to include a burn promoter in the wrapper to balance the effect of the discontinuous coating areas.

Various other applications and processes for reducing ignition proclivity of a cigarette are known as, for example, by U.S. Pat. No. 4,453,553; U.S. Pat. No. 4,480,650; U.S. Pat. No. 4,739,775; U.S. Pat. No. 4,489,738; U.S. Pat. No. 4,715,345; U.S. Pat. No. 2,666,437; U.S. Pat. No. 4,622,983; and European Patent Application 0 559 300 82.

Although, as described in the above cited references, various methods and processes are known for applying discrete bands of porosity reducing material to cigarette papers, such conventional techniques have a significant drawback in that a noticeable change in the smoking characteristics of the cigarette can be detected as the cigarette coal burns into the treated bands. This is particularly noticeable if a puff is being drawn as the burning coal reaches the division between a treated and non-treated portion of the paper. A noticeable difference in taste and smoke delivery is discernable by the smoker depending on the difference in permeabilities between the untreated and treated sections of the paper. Thus, what is needed, is a paper which remains effective in reducing ignition propensity or proclivity while minimizing the chance of discernable changes in smoke delivery and taste to a smoker.

OBJECTS AND SUMMARY OF THE INVENTION

It is a principle object of the present invention to provide a smoking article having improved ignition proclivity characteristics.

An additional object of the present invention is to provide a smoking article wherein the mechanism for improving ignition proclivity does not adversely affect smoke delivery or taste.

Still a further object of the present invention is to provide a smoking article wrapper which significantly reduces ignition proclivity of a smoking article without adversely affecting smoking characteristics.

Additional objects and advantages of the invention will be set forth in part in the following description, or will be obvious from the description, or may be learned through practice of the invention.

To achieve the objects and in accordance with the purposes of the invention, as embodied and broadly described herein, a smoking article is provided comprising a tobacco column and a wrapper surrounding the tobacco column. The wrapper comprises discrete areas of reduced permeability for improving ignition proclivity characteristics of the smoking article. The discrete areas of reduced permeability may be defined as cross-directional bands surrounding the smoking article. The reduced permeability areas define a gradually changing permeability profile. For example, the profile may gradually decrease in a burning direction of the smoking article such that a change in permeability in the reduced permeability areas increases from a zero permeability reduction to a maximum permeability reduction in the burning direction of the smoking article. The smoking article according to the invention may further include an area of sustained maximum permeability reduction following the gradually decreasing permeability profile. The smoking article may also include a gradually increasing permeability profile following the gradually decreasing permeability profile in the burning direction of the smoking article with an area of sustained maximum permeability reduction between the gradually decreasing and gradually increasing permeability profiles. For example, the discrete areas may take on a ramped-up and ramped-down profile.

The discrete areas of reduced permeability may comprise areas treated with a film forming solution to reduce permeability of the smoking article wrapper in the treated areas. The film forming solution may comprise any type of solution which, when dried, forms a film which reduces permeability of the smoking article wrapper to a level necessary for reducing ignition proclivity, or the tendency of the smoking article to self-extinguish if left or dropped on a flammable substrate. For example, the solution may comprise an aqueous solution or a non-aqueous solution. The non-aqueous solution may be a solution of a solvent soluble cellulosic polymer dissolved in a non-aqueous solvent. The solution may also comprise a particulate non-reactive filler material to enhance or improve the film forming ability of the solution.

The discrete treated areas, especially in the embodiment wherein the areas comprise ramp-shaped bands, should have a width which ensures that the smoking article will self-extinguish once the burning coal of the smoking article advances into the treated area. The width of the treated area is, thus, a function of the permeability reduction of the treated area. A desired permeability range for the maximum sustained permeability reduction of the treated areas is less than 6 ml/min/cm$^2$, and generally within a range of essentially 2 to 6 ml/min/cm$^2$. In this range, the area of maximum permeability preferably has a length of at least 4 mm.

The present invention also relates to a smoking article wrapper, such as a cigarette paper, having discrete areas of reduced permeability for improving ignition proclivity control of a smoking article. The reduced permeability areas are essentially as described above with regards to the smoking article according to the invention.

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Reference now will be made in detail to the presently preferred embodiments of the invention, one or more examples of which are illustrated in the accompanying drawings. Each example is provided by way of explanation of the invention, and not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents.

Figure 1:
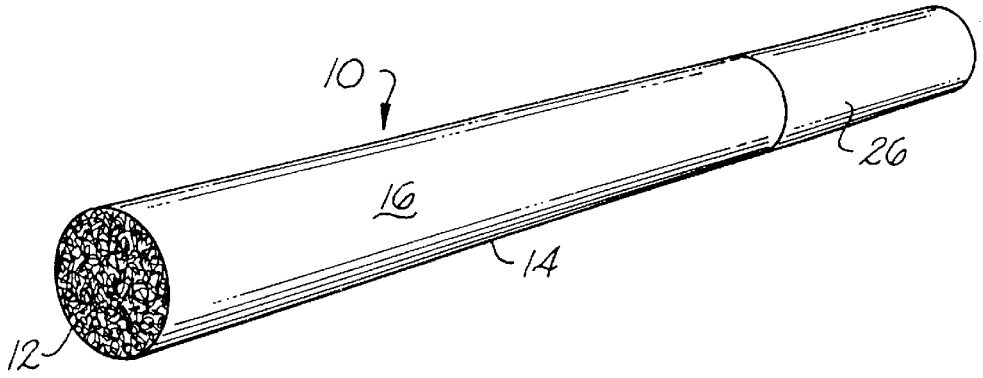
FIG. 1 is a perspective view of a smoking article, specifically a cigarette, according to the invention.
Figure 2:
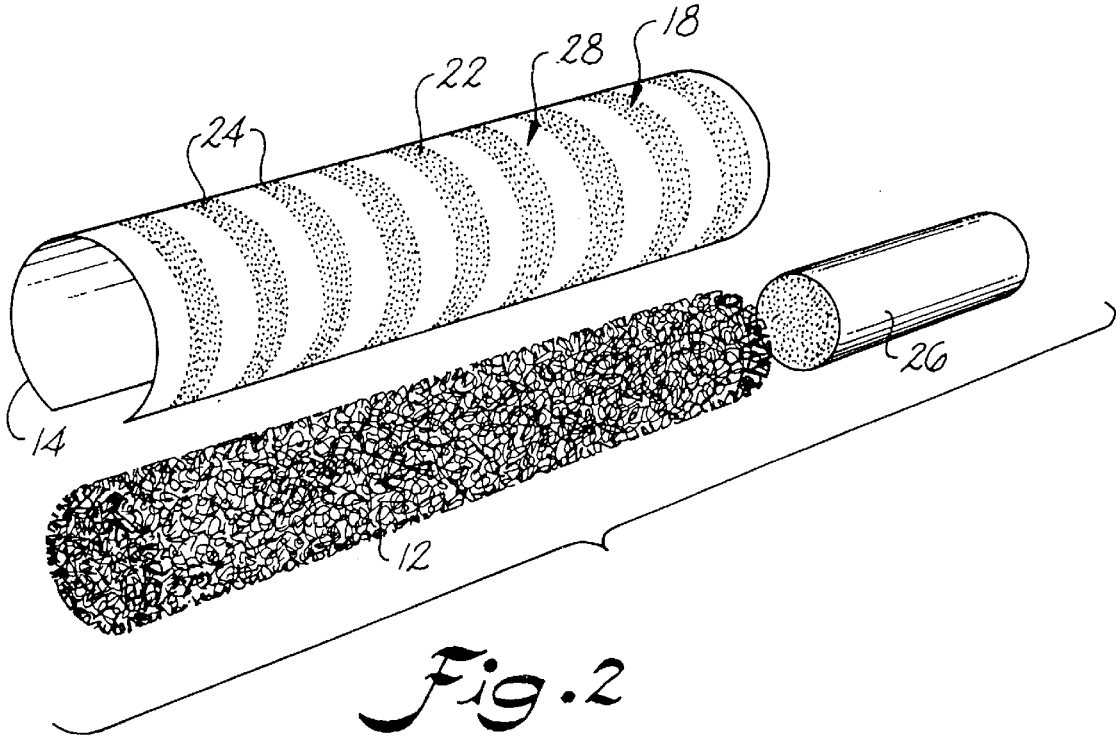
FIG. 2 is a component view of the smoking article of FIG. 1 particularly illustrating the treated areas of the cigarette wrapper.

FIGS. 1 and 2, and the following discussion related thereto, relate to a preferred non-aqueous solution for treating discrete areas of the smoking article wrapper to reduce permeability of the wrapper in a treated areas to a level which tends to cause the smoking article to self extinguish as the burning coal of the smoking article advances into the treated areas. The discussion of FIGS. 1 and 2 relates particularly to a non-aqueous solution which applicants have found to be particularly suited for the present invention. In FIGS. 1 and 2, the treated areas are applied as spaced apart bands along the length of the smoking article. The bands of this embodiment do not necessarily incorporate the decreasing and increasing permeability profiles according to FIGS. 3–6, as will be discussed more fully below. However, the non-aqueous film-forming solution discussed below in regards to FIGS. 1 and 2 pertains to the present invention in that the respective non-aqueous film-forming solution is preferred in forming the inventive ramp-shaped bands according to the invention.

It should, however, be understood that the present invention relating to the uniquely shaped bands or areas of reduced permeability is not limited in any way to the non-aqueous solution discussed herein. The present invention relates to a unique shape or pattern for the discreted areas which can be formed with any manner of film-forming solutions, including non-aqueous and aqueous solutions. The discussion herein related to non-aqueous solutions is provided for means of explanation of the invention, and as an illustration of a preferred embodiment of a particularly useful solution. It should be understood by those skilled in the art that any manner of film-forming solutions are within the scope and spirit of the invention. For example, the prior art describes the application of fibrous slurries and/or any manner of film-forming solutions to cigarette papers to reduce permeability and control the burn rate of the cigarette. Aqueous solutions which have been found effective include alginate, pectin, carboxymethyl-cellulose, and polyvinyl alcohol. Fibrous slurries applied from an aqueous solution are also effective. These include microcrystalline cellulose, cellulon bacterial cellulose, and highly refined wood pulp fibers. Also, natural polymers soluble in non-aqueous solvents are also effective. Any and all such solutions are within the scope and spirit of the presently claimed invention.

For purposes of explanation of the invention, the embodiments and principles of the invention will be discussed in regards to a cigarette. However, this is for purposes of explanation of the invention only and is not meant to limit the invention only to cigarettes. Any manner of smoking article is within the scope and spirit of the invention.

The invention relates to a smoking article, and a wrapper for a smoking article, having improved ignition proclivity control characteristics. "Ignition proclivity" is a measure of the tendency of the smoking article or cigarette to ignite a flammable substrate if the burning cigarette is dropped or otherwise left on a flammable substrate. A test for ignition proclivity of a cigarette has been established by NIST (National Institute of Standards and Technology) and comprises placing a smoldering cigarette on a flammable test fabric and noting the tendency of the cigarette to either ignite the test fabric, burn the test fabric beyond a normal char line of the fabric, burn its entire length without igniting the fabric, or self-extinguish before igniting the test fabric or burning its entire length.

A preferred embodiment of the invention is illustrated generally in FIGS. 1 and 2. A smoking article (cigarette), generally 10, having improved ignition proclivity characteristics includes a tobacco column 12 within a wrapper 14. Article 10 may include a filter 26. Wrapper 14 may include any manner of commercially available cigarette wrapper, such as KC grade 603 paper by Kimberly-Clark Corporation. It should be understood that any other manner of paper web may be used in this regard.

Paper web 14 defines an outer circumferential surface 16 when wrapped around tobacco column 12. Discrete areas 18 of outer circumferential surface 16 are treated with a non-aqueous solution. This solution includes a solvent soluble cellulosic polymer material dissolved in a non-aqueous solvent. The solution also includes a particulate inorganic non-reactive filler disbursed or suspended in the solution, as discussed more fully below. It should also be understood that treated areas 18 could be disposed on the inner surface of web 14 so as to be adjacent the tobacco column 12.

In the embodiment illustrated, treated areas 18 are defined as circumferential cross-directional bands 24. Bands 24 are spaced apart from each other longitudinally along the length of cigarette 10. The bands 24, and particularly the fine particulate filler 22 are indicated in phantom in FIG. 2. However, it should be understood that the treated areas are essentially invisible in the formed cigarette as shown in FIG. 1. In other words, a smoker cannot discern from any outward sign that the wrapper 14 has been treated in discrete areas 18. In this regard, treated areas 18 have a smooth and flat texture essentially the same as untreated areas 28.

Treated areas 18, or bands 24, have a permeability within a range which is known to provide improved ignition proclivity characteristics for the make-up of cigarette 10. As the coal of cigarette 10 burns into one of bands 24, oxygen available to the burning coal is substantially reduced due to the decreased permeability of wrapper 14 in the treated areas. The reduction of oxygen causes the cigarette to self-extinguish in the treated areas 18. Applicants have determined that a preferred permeability is less than 6 $ml/min/cm^2$ (CORTESA), and generally within a range of 2 to 6 $ml/min/cm^2$. Applicants have found that this range provides the desired self-extinguishing results as the cigarette coal burns into the treated areas.

The width and spacing of bands 24 are dependent on a number of variables, such as the initial permeability of wrapper 14, density of tobacco column 12, etc. The bands 24 preferably have a width so that oxygen is limited to the burning coal for a sufficient length or period of time to extinguish the coal. In other words, if band 24 were too narrow, the burning coal would burn through band 24 before self-extinguishing. Applicants have determined that, for the cigarettes tested, a minimum band width of 4 mm is desired.

The spacing between bands 24 is also a factor of a number of variables. The spacing should not be so great that the cigarette burns for a sufficient length or time to ignite a substrate before the coal ever burns into a treated area 18. The spacing between bands 24 also affects the thermal inertia of the burning coal, or the ability of the coal to burn through the treated bands 24 without self-extinguishing. In other words, the spacing between bands 24 should not be so great that the burning coal burns hot enough and fast enough to burn through one of the bands 24 when it comes into contact with the respective band. On the other hand, the spacing between bands 24 should not be so small that the cigarette tends to burn out or self-extinguish in a free burn state. In the cigarettes tested, applicants have found that a band spacing of between 5 and 10 mm is appropriate. However, it should be understood that the band spacing can be any suitable width as determined by any number of variables.

The solution applied to wrapper 14 in treated areas 18 provides the reduced permeability in the treated areas. Applicants have found that a non-aqueous solution of a solvent soluble cellulosic polymer with a particulate inorganic non-reactive filler suspended in solution works particularly well. The non-aqueous solvent tends not to disrupt the inter-fiber bonding (e.g. hydrogen bonding) of the paper web and, thus, does not significantly decrease the strength of the paper web. Also, the non-aqueous solvent does not cause the paper web to crinkle or pucker when the solvent is dried. This allows for the wrapper 14 to have a smooth and aesthetically pleasing appearance.

Applicants have found that a particularly well suited non-aqueous solvent is a mixture of an alcohol and an acetate, for example a 50/50 mix of isopropyl alcohol and ethyl acetate. However, it should be understood, that this is but a preferred solvent, and any suitable non-aqueous solvent or solvent mixture may be utilized in this regard. For example a 60/40 mix of normal propyl acetate and normal propyl alcohol has also been shown to work particularly well. Applicants have also found that a well suited solvent soluble cellulosic polymer is ethyl cellulose in a concentration of approximately 15% to 35% by weight of solution and preferably around 25% by weight of solution. However, any cellulosic based polymer can be used in this regard, including hydroxy propyl cellulose.

A non-reactive inorganic particulate filler 22 is added to the solution. Applicants have found that filler 22 significantly improves the ability of the treated areas 18 to self-extinguish the burning coal. The solution with filler is more effective in reducing permeability of the paper web in treated areas 18. Applicants believe that the inorganic filler 22 forms a layer on the surface of wrapper 14 with the ethyl cellulose acting as a binder or "glue" for the filler particles. Applicants believe that the filler particles do not tend to strike into the pores of wrapper 16 and form a relatively smooth surface coating. The filler and cellulosic polymer form a coherent and smooth surface coating which significantly reduces paper permeability in the treated areas. It is also believed that the solution containing the inorganic filler particles is less affected by the heat of the burning cigarette, thus ensuring that the coating remains intact so as to be effective in restricting oxygen to the burning coal.

Any number of inorganic fillers may be suitable in the present invention. Any filler material which can be homogeneously disbursed in the non-aqueous solution to form a surface film with the cellulosic polymer without affecting the texture or appearance of the wrapper may be used. Applicants have found that particularly well-suited fillers are chalk, clay, and titanium oxide.

The present invention also pertains to a smoking article wrapper for use with smoking articles, as essentially described above, as well as a method for making the smoking article wrapper. The inventive method for producing the smoking article wrapper having improved ignition proclivity control characteristics includes applying a non-aqueous solution of a film forming cellulosic polymer and non-aqueous solvent with an inorganic particulate filler material suspended in the solution to a smoking article paper in discrete treated areas 18, such as bands 24 as described above. The treated areas are then dried so that essentially all of the non-aqueous solvent is removed leaving a film of the cellulosic material and filler material on the paper in treated areas 18. The method includes applying the non-aqueous solution so that dried treated areas 18 have a permeability within a range known to cause self-extinguishing of the cigarettes, for example, within a range of 2 to 6 ml/min/cm$^2$.

The method also includes printing the solution onto the paper web in the discrete areas by means of conventional high speed printing operations. Applicants have found that suitable printing techniques include gravure and flexographic printing. The treated areas can be applied in the printing operations in either a single pass or multiple passes. The viscosity of the solution is controlled accordingly to be suitable with the high speed printing techniques. Applicants have also found that the desired target permeability ranges are readily achieved by applying the solution to the treated areas in multiple passes with the conventional printing machines. However, it is also possible to achieve the desired permeability range by applying the solution in a single pass and controlling the viscosity and amount of solution applied.

The following examples relate to cigarettes produced according to the invention and are provided to more fully explain the invention. In each of the examples, the coatings were applied in a three pass process without intermediate drying. The base paper was Kimberly-Clark grade 603 paper with an average untreated permeability of 32.6 ml/min/cm$^2$. The measured viscosity for the solution was 45 seconds using a Zahn #2 Cup Viscometer.

EXAMPLE 1

In a first series, ALPHATEX clay (Anhydrous China clay) by Anglo-American Clay Corporation was added to a base solution of ethyl cellulose (approximately 25% by weight of solution) dissolved in a 60/40 mixture of normal propyl acetate and normal propyl alcohol. A 10 mm band of solution was printed in a 3-pass process on a base Kimberly-Clark KC Grade 603 paper with an initial average porosity of 32.6 ml/min/cm$^2$. The clay was added at 3% weight of solution with a coat weight of the treated areas of 3.0 g/m$^2$. Average permeability of this set of cigarettes was 3.1 ml/min/cm$^2$. 3 of 3 cigarettes tested self-extinguished at or near the coated area.

EXAMPLE 2

In a second series, ALPHATEX clay (Anhydrous China clay) by Anglo-American Clay Corporation was added to a base solution of ethyl cellulose (approximately 25% by weight of solution) dissolved in a 60/40 mixture of normal propyl acetate and normal propyl alcohol. A 10 mm band of solution was printed in a 3-pass process on a base Kimberly-Clark KC Grade 603 paper with an initial average porosity of 32.6 ml/min/cm$^2$. The clay was added at 6% weight of solution. Average permeability of this set was 1.6 ml/min/cm$^2$. 4 of 4 cigarettes tested self-extinguished at or near the coated area.

EXAMPLE 3

In a third series, $TiO_2$ was added to a base solution of ethyl cellulose (approximately 25% by weight of solution) dissolved in a 60/40 mixture of normal propyl acetate and normal propyl alcohol. The $TiO_2$ was added in the form of a white ink. The ink was approximately 10% $TiO_2$ with a nitrocellulose binder. A 10 mm band of solution was printed in a 3-pass process on a base Kimberly-Clark KC Grade 603 paper with an initial average porosity of 32.6 ml/min/cm$^2$. The $TiO_2$ was added at 0.5% by weight of solution with a coat weight of the treated areas being 3.4 g/m$^2$. Average permeability of this set was 3.2 ml/min/cm$^2$. 4 of 4 cigarettes tested self-extinguished at or near the coated area.

EXAMPLE 4

In a fourth series, $TiO_2$ was added to a base solution of ethyl cellulose (approximately 25% by weight of solution) dissolved in a 60/40 mixture of normal propyl acetate and normal propyl alcohol. The $TiO_2$ was added in the form of a white ink. The ink was approximately 10% $TiO_2$ with a nitrocellulose binder. A 10 mm band of solution was printed in a 3-pass process on a base Kimberly-Clark KC Grade 603 paper with an initial average porosity of 32.6 ml/min/cm$^2$. The $TiO_2$ was added at 1.0% by weight of solution with a coat weight of the treated areas being 4.2 g/m$^2$. Average permeability of this set was 1.8 ml/min/cm$^2$. 4 of 4 cigarettes tested self-extinguished at or near the coated area.

EXAMPLE 5

In a fifth series, $TiO_2$ was added to a base solution of ethyl cellulose (approximately 25% by weight of solution) dissolved in a 60/40 mixture of normal propyl acetate and normal propyl alcohol. The $TiO_2$ was added in the form of a white ink. The ink was approximately 10% $TiO_2$ with a nitrocellulose binder. A 10 mm band of solution was printed in a 3-pass process on a base Kimberly-Clark KC Grade 603 paper with an initial average porosity of 32.6 ml/min/cm$^2$. The $TiO_2$ was added at 1.2% by weight of solution with a coat weight of the treated areas being 4.7 g/m$^2$. Average permeability of this set was 0.91 ml/min/cm$^2$. 4 of 4 cigarettes tested self-extinguished at or near the coated area.

EXAMPLE 6

In a sixth series, $TiO_2$ was added to a base solution of ethyl cellulose (approximately 25% by weight of solution) dissolved in a 60/40 mixture of normal propyl acetate and normal propyl alcohol. The $TiO_2$ was added in the form of a white ink. The ink was approximately 10% $TiO_2$ with a nitrocellulose binder. A 10 mm band of solution was printed in a 3-pass process on a base Kimberly-Clark KC Grade 603 paper with an initial average porosity of 32.6 ml/min/cm$^2$. The $TiO_2$ was added at 2.5% by weight of solution with a coat weight of the treated areas being 4.9 g/m$^2$. Average permeability of this set was 0.74 ml/min/cm$^2$. Since the permeability of this set was less than the 0.91 of Example 5, it was not necessary to test for ignition proclivity. It was fully expected any cigarettes treated with the composition would self-extinguish.

EXAMPLE 7

In a seventh series, $TiO_2$ was added to a base solution of ethyl cellulose (approximately 25% by weight of solution)

dissolved in a 60/40 mixture of normal propyl acetate and normal propyl alcohol. The $TiO_2$ was added in the form of a white ink. The ink was approximately 10% $TiO_2$ with a nitrocellulose binder. A 10 mm band of solution was printed in a 3-pass process on a base Kimberly-Clark KC Grade 603 paper with an initial average porosity of 32.6 ml/min/cm$^2$. The $TiO_2$ was added at 5.0% by weight of solution with a coat weight of the treated areas being 9.7 g/m$^2$. Average permeability of this set was 0.29 ml/min/cm$^2$. Since the permeability of this set was less than the 0.91 of Example 5, it was not necessary to test for ignition proclivity. It was fully expected that any cigarettes treated with the composition would self-extinguish.

EXAMPLE 8

In another series, MULTIFLEX chalk (precipitated calcium carbonate) from Specialty Minerals, Inc. was added to a base solution of ethyl cellulose (approximately 25% by weight of solution) in a 50/50 solvent of normal propyl acetate and normal propyl alcohol. The chalk was added at 9% weight of solution. 5 mm cross direction bands were printed on a base Kimberly-Clark KC Grade 603 paper with an initial average porosity of 32.6 ml/min/cm$^2$ in a 3-pass gravure printing operation. Average permeability for the treated areas was less than 2 ml/min/cm$^2$. In ignition proclivity tests conducted on a # 4 cotton duck material with a film underneath, 3 of 5 cigarettes self-extinguished and 1 cigarette burned its entire length without igniting the substrate. In tests conducted on a # 6 cotton duck material without film, 1 of 6 cigarettes self-extinguished. In this test, it appeared that the 5 mm band width was not enough to extinguish the cigarette and the 10 mm band spacing was too great to prevent an ignition.

Although, as discussed above, the printing of cross-directional (CD) bands of permeability reducing materials on cigarette paper has been demonstrated to be effective in reducing permeability and ignition propensity of cigarettes, such bands may also have an undesirable discontinuous effect on the delivery of smoke and taste to the smoker. These undesirable effects may exist regardless of the type of solution used to form the bands. For example, if the change in permeability between the treated areas and untreated areas of the cigarette is relatively great, the smoker will discern a difference in taste and smoke delivery. The applied solutions themselves may also affect the taste of the cigarette. The present invention also relates to a unique design or profile for the cross-direction bands to minimize the affect of the bands on smoke delivery and taste to the smoker. The present unique design for the bands provides a more uniform smoke delivery over the entire length of the cigarette.

Figure 3:
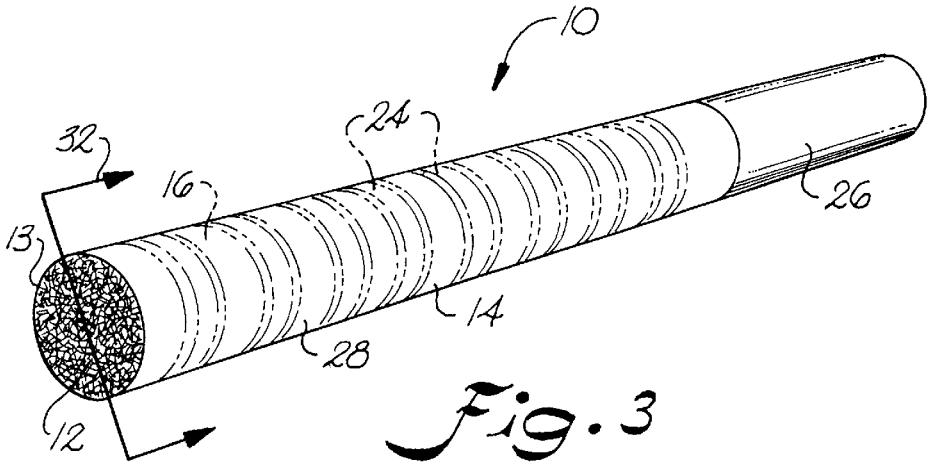
FIG. 3 is a perspective view of a smoking article according to the invention particularly illustrating the ramp-shaped treated areas.
Figure 4:
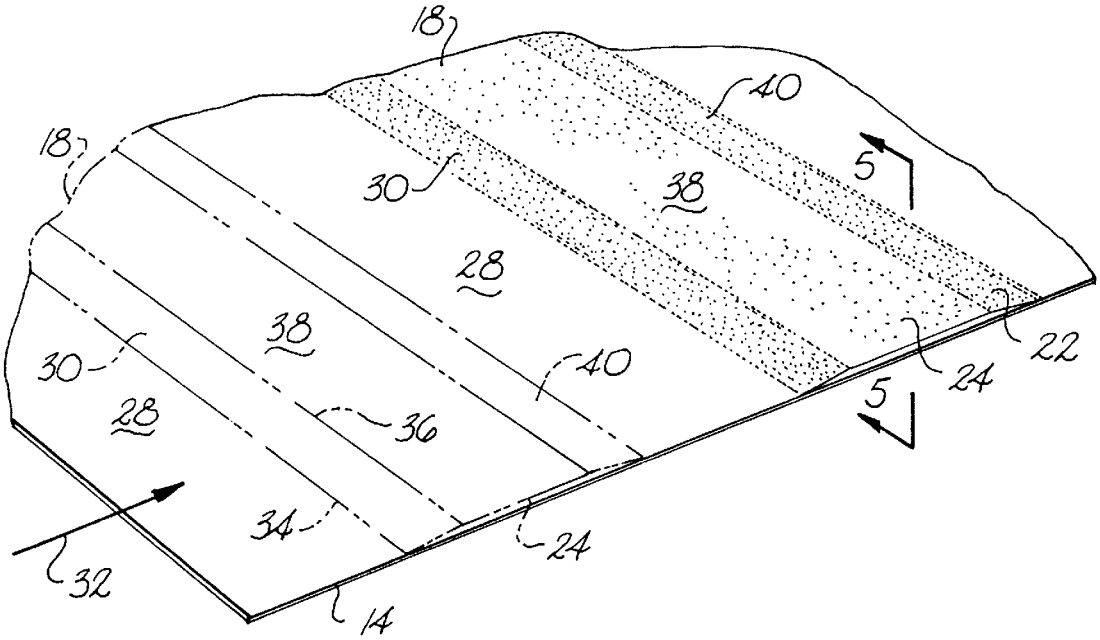
FIG. 4 is an exploded view of the cigarette wrapper shown in FIG. 3 particularly illustrating the ramp-shaped profiles of the treated areas.

Referring particularly to FIGS. 3 and 4, a smoking article 10 according to the invention is illustrated. Again, the smoking article 10 is illustrated as a cigarette but this is not meant as a limitation of the invention. Smoking article 10 includes a tobacco column 12 surrounded by a paper wrapper 14. Wrapper 14 defines an outer circumferential surface 16 of the smoking article. Surface 16 has discrete treated areas 18 defined thereon for reducing the permeability of wrapper 14, as discussed in detail above in regards to FIGS. 1 and 2. It should also be appreciated that treated areas 18 could also be defined on the inner surface of web 14 so as to be adjacent the tobacco.

In use, smoking article 10 is lit by a smoker at end 13 and has a burning direction 32 towards filter 26, as commonly understood in the art. As the burning coal of the smoking article advances in direction 32, it eventually meets the treated areas 18 or bands 24. Treated areas 18 are separated or spaced apart by untreated areas 28. Thus, the burning coal alternates in its progression from treated areas to untreated areas.

According to the invention, the treated areas of reduced permeability define a gradually decreasing permeability profile 30 in the burning direction 32. The gradually decreasing permeability profile 30 is defined such that the burning coal does not engage the maximum permeability reduction of the band 24 all at once, but gradually burns into the area of maximum permeability reduction. In this manner, the change in taste and smoke delivery to the smoker occurs over a gradual period and is less discernable to the smoker.

Referring particularly to FIG. 4, the profiles of bands 24 are particularly illustrated. It can be readily seen that as a burning coal of the cigarette advances in direction 32, it first encounters area 30 of gradually decreasing permeability. In other words, the thickness of the permeability reducing film increases from a minimum point 34 to a maximum point 36. As the film increases in thickness between points 34 and 36, the permeability of the paper also gradually decreases until it reaches a minimum permeability, or area of greatest permeability reduction, at point 36. The coal will then burn or advance through an area 38 of sustained maximum reduction.

FIG. 4 diagrammatically illustrates two types of bands. The first band shown in dashed lines is meant to illustrate a film formed by any type of film-forming solution, such as an aqueous solution, non-aqueous solution, or other solution. The second band 24 shown in the burning direction 32 is meant to illustrate a band formed with the non-aqueous solution of a solvent soluble cellulosic polymer dissolved in a non-aqueous solvent with a particulate non-reactive filler 22 disbursed in the solution, as described in detail in regards to FIGS. 1 and 2. However, it should be understood, that the benefits of the unique gradually decreasing permeability profile can be realized regardless of the type of solution used to form bands 24.

The area of sustained permeability reduction 38 preferably has a width which is great enough to cause the cigarette to self-extinguish if it is dropped or otherwise left on a flammable substrate. The width of area 38 is dependent upon a number of variables, including permeability of the treated area, type of base paper, spacing between the bands, etc. The width of bands 24 and space between the bands 28 can vary accordingly. Applicants have found that, if the area of maximum permeability reduction is within a range of 2 to 6 ml/min/cm$^2$, a width for area 38 should be at least 4 mm. Also, as discussed above in detail with regards to FIGS. 1 and 2, the spacing between the bands is also an important consideration. The spacing should not be so great that the burning coal will ignite a flammable substrate before it ever advances into a treated area. Also, the spacing should not be so great that the burning coal generates enough thermal inertia to burn through the treated areas before self-extinguishing.

Figure 5:
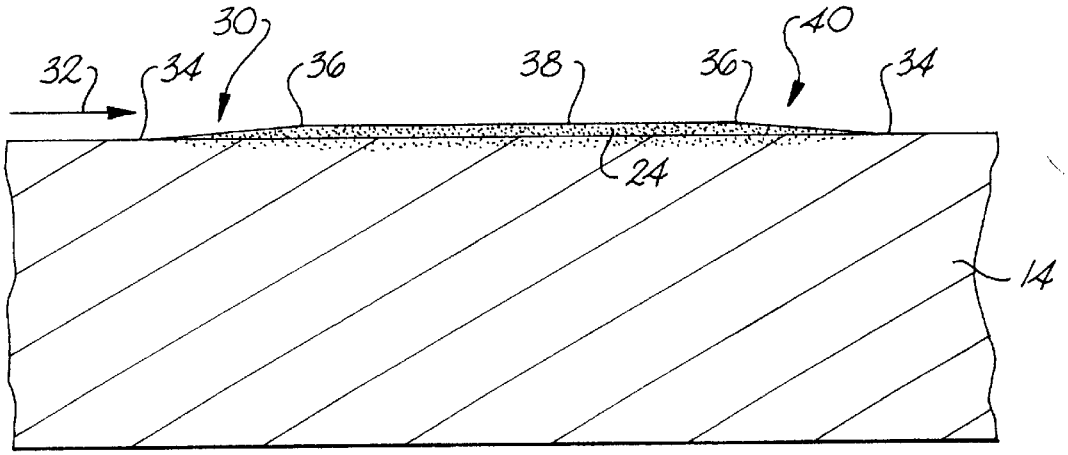
FIG. 5 is a cross-sectional view of the wrapper shown in FIG. 4 taken along the lines indicated.

As shown particularly in FIGS. 4 and 5, bands 24 may also include an area 40 of gradually increasing permeability following areas 30 and 38 in the burning direction 32 of the cigarette. Areas 40 of gradually increasing permeability allow the advancing coal to gradually burn into untreated areas 28 without generating an abrupt change in smoke delivery or taste.

Figure 6A:
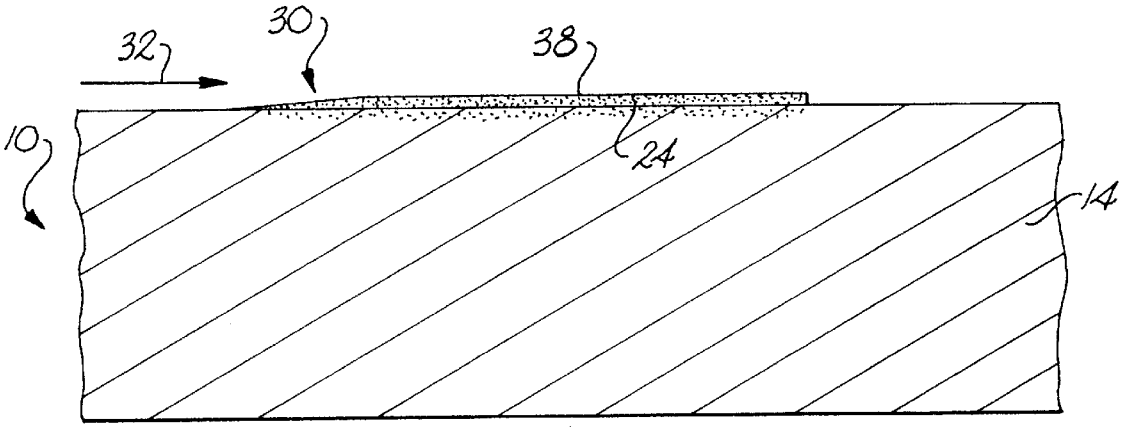
FIGS. 6*a* and 6*b* are alternate cross-sectional views of the ramp-shaped treated areas formed on the smoking article wrapper.
Figure 6B:
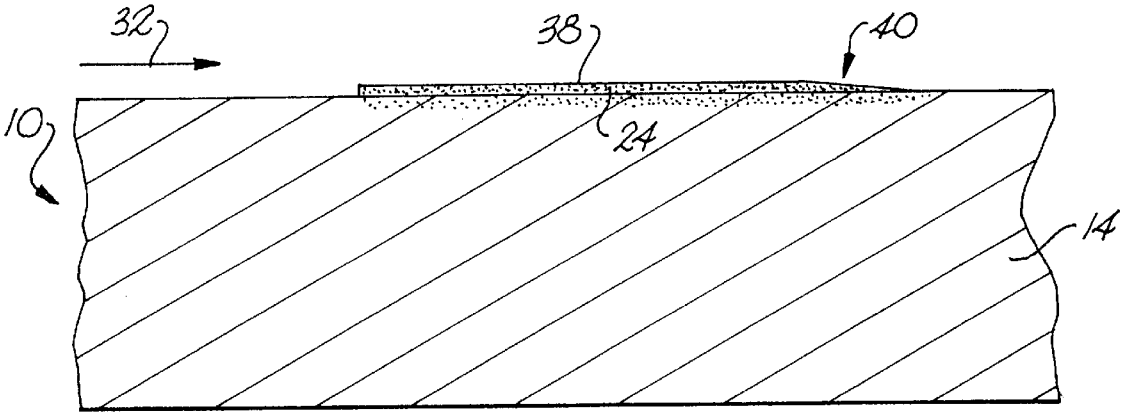

FIG. 6*a* illustrates an embodiment wherein band 24 includes only a gradually decreasing area of permeability 30 in the burning direction 32 of the cigarette. Similarly, FIG.

6*b* illustrates an embodiment wherein band 24 includes only an area 40 of increasing permeability.

The areas of changing permeability 30, 40 can have a relatively smooth or flat profile, such as is shown in the drawings, wherein bands 24 have a ramp-up and/or ramp-down profile. Applicants have found that this type of profile can be applied directly to wrappers 14 by direct commercial printing techniques, such as gravure or flexographic printing. The treated areas can be applied in a multiple pass or single pass operation depending on the amount of solution applied and viscosity of solution.

In an alternative embodiment not particularly illustrated in the figures, the areas of increasing and decreasing permeability 30, 40 can comprise a step-up and/or step-down profile. In other words, bands 24 could be formed by layers having a successively decreasing width. This type of band could be applied in a multiple pass gravure or flexographic printing operation.

The following examples of cigarettes having CD bands formed according to the present invention are provided below for purposes of illustration and explanation of the invention.

EXAMPLE 9

In this series, ramp-pattern CD bands were printed on Kimberly-Clark Corporation KC Grade 603 paper. The ramp pattern consisted of a 2.5 mm ramp-up area with coverage increasing gradually from 0% to 100%. A 5 mm area of maximum 100% coverage followed the ramp-up area. A 2.5 mm ramp-down area with coverage decreasing from 100% to 0% followed the 5 mm area of sustained maximum coverage. The ramp pattern was engraved on a gravure roll and used to print cigarette papers on a commercial gravure press in a 3 pass process. The solution used was ethyl cellulose (approximately 25% by weight of solution) in a 50/50 solvent of normal-propyl acetate and normal-propyl alcohol with Multiflex chalk added at 9% weight of solution. With the Multiflex chalk filler, viscosity of the solution was 39 cup seconds. The bands were printed at a spacing of 10 mm. In ignition proclivity tests conducted on a # 4 cotton duck material with a film underneath, 6 of 6 cigarettes self-extinguished. In tests conducted on a # 6 cotton duck material without film, 3 of 6 cigarettes self-extinguished. In this test, it appeared that the 10 mm band spacing was too great to prevent an ignition in three of the cigarettes. It will be apparent to those skilled in the art that various modifications and variations can be made in the present invention without departing from the scope or spirit of the invention. For example, the dimensions of the ramp-up and ramp-down sections and area of maximum permeability reduction can be varied accordingly to achieve the desired results. Additionally, the treated areas can be formed by any manner of solution, including aqueous and non-aqueous solutions. Thus, it is intended that the present invention cover the modifications and variations of this invention provided they come within the scope of the appended claims and their equivalents.

What is claimed is:

1. A smoking article comprising a tobacco column, and a wrapper surrounding said tobacco column, said smoking article having a first end, a second end, and a longitudinal axis extending from said first end to said second end, said wrapper comprising discrete areas of reduced permeability for improving ignition proclivity characteristics of said smoking article, said discrete areas of reduced permeability comprising areas treated with a film forming composition, said discrete areas being in the shape of bands spaced along said longitudinal axis, said reduced permeability areas defining a gradually decreasing permeability profiled in the longitudinal direction such that permeability reduction in said reduced permeability areas gradually increases from a minimum zero permeability reduction to a maximum permeability reduction.

2. The smoking article as in claim 1, further comprising an area of sustained maximum permeability reduction following said gradually decreasing permeability profile.

3. The smoking article as in claim 2, wherein said discrete areas of reduced permeability comprise a substantially ramp-shaped profile.

4. The smoking article as in claim 1, wherein said discrete areas of reduced permeability further comprise a gradually increasing permeability profile following said gradually decreasing permeability profile.

5. The smoking article as in claim 4, further comprising an area of sustained maximum permeability reduction between said gradually increasing and gradually decreasing permeability profiles.

6. The smoking article as in claim 5, wherein said discrete areas of reduced permeability comprise a substantially ramp-shaped profile with increasing and decreasing ramp sections.

7. The smoking article as in claim 1, wherein said treated areas comprise areas treated with a film forming aqueous solution.

8. The smoking article as in claim 1, wherein said treated areas comprise areas treated with a non-aqueous solution of a solvent soluble cellulosic polymer dissolved in a non-aqueous solvent.

9. The smoking article as in claim 8, wherein said solution further comprises a particulate non-reactive filler material.

10. The smoking article as in claim 1, wherein said discrete areas of reduced permeability comprise an area of maximum reduced permeability of less than 6 ml/min/cm$^2$.

11. The smoking article as in claim 10, wherein said area of maximum reduced permeability has a length of at least 4 mm in the direction.

12. A smoking article wrapper having discrete areas of reduced permeability for improving ignition proclivity control of a smoking article, said discrete areas comprising areas treated with a film forming composition, said discrete areas being in the shape of horizontal bands spaced apart in a longitudinal direction, said reduced permeability areas defining at least one gradually changing permeability profile in the longitudinal direction such that permeability in said changing permeability area gradually changes from zero permeability reduction to a maximum permeability reduction.

13. The smoking article wrapper as in claim 12, wherein said changing permeability profile comprises a gradually decreasing permeability profile in said longitudinal direction such that permeability reduction in said reduced permeability areas increases from zero permeability reduction to a maximum permeability reduction.

14. The smoking article wrapper as in claim 13, further comprising an area of sustained maximum permeability reduction following said gradually decreasing permeability profile.

15. The smoking article wrapper as in claim 13, wherein said discrete areas of reduced permeability further comprise a gradually increasing permeability profile following said gradually decreasing permeability profile in said longitudinal direction of said wrapper.

16. The smoking article wrapper as in claim 15, further comprising an area of sustained maximum permeability reduction between said gradually increasing and gradually decreasing permeability profiles.

17. The smoking article wrapper as in claim 16, wherein said discrete areas of reduced permeability comprise a substantially ramp-shaped profile with increasing and decreasing ramp sections.

18. The smoking article wrapper as in claim 12, wherein said discrete areas of reduced permeability have a substantially ramp-shaped profile.

19. The smoking article wrapper as in claim 16, wherein said treated areas comprise areas treated with a file forming aqueous solution.

20. The smoking article wrapper as in claim 12, wherein said treated areas comprise areas treated with a non-aqueous solution of a solvent soluble cellulosic polymer dissolved in a non-aqueous solvent.

21. The smoking article wrapper as in claim 20, wherein said solution further comprises a particulate non-reactive filler material.

22. The smoking article wrapper as in claim 12, wherein said discrete areas of reduced permeability comprise an area of maximum reduced permeability of less than 6 ml/min/$cm^2$.

23. The smoking article wrapper as in claim 22, wherein said area of maximum reduced permeability has a longitudinal length of at least 4 mm.

24. The smoking article as in claim 1, wherein said bands are continuous around the circumference of the smoking article.

25. The smoking article wrapper as in claim 12, wherein said bands extend the entire width of said wrapper.

* * * * *

US005878753C1

(12) EX PARTE REEXAMINATION CERTIFICATE (8644th)

United States Patent
Peterson et al.

(10) Number: US 5,878,753 C1
(45) Certificate Issued: Nov. 1, 2011

(54) SMOKING ARTICLE WRAPPER FOR CONTROLLING IGNITION PROCLIVITY OF A SMOKING ARTICLE WITHOUT AFFECTING SMOKING CHARACTERISTICS

(75) Inventors: Richard M. Peterson, Marietta, GA (US); Joseph S. Kucherovsky, Philadelphia, PA (US)

(73) Assignee: Schweitzer-Mauduit International, Inc., Alpharetta, GA (US)

Reexamination Request:
No. 90/011,458, Jan. 26, 2011

Reexamination Certificate for:

| | |
|---|---|
| Patent No.: | **5,878,753** |
| Issued: | **Mar. 9, 1999** |
| Appl. No.: | **08/815,434** |
| Filed: | **Mar. 11, 1997** |

(51) Int. Cl.
*A24D 1/02* (2006.01)

(52) U.S. Cl. ..... 131/365; 131/349; 131/336

(58) Field of Classification Search ..... None
See application file for complete search history.

(56) References Cited

To view the complete listing of prior art documents cited during the proceeding for Reexamination Control Number 90/011,458, please refer to the USPTO's public Patent Application Information Retrieval (PAIR) system under the Display References tab.

*Primary Examiner*—Carlos Lopez

(57) ABSTRACT

A smoking article wrapper has discrete areas of reduced permeability for improving ignition proclivity characteristics of a smoking article. The reduced permeability areas define a gradually decreasing permeability profile in a burning direction of the smoking article such that permeability reduction in the reduced permeability areas increases from a minimum reduction to a maximum permeability reduction in the burning direction of the smoking article.

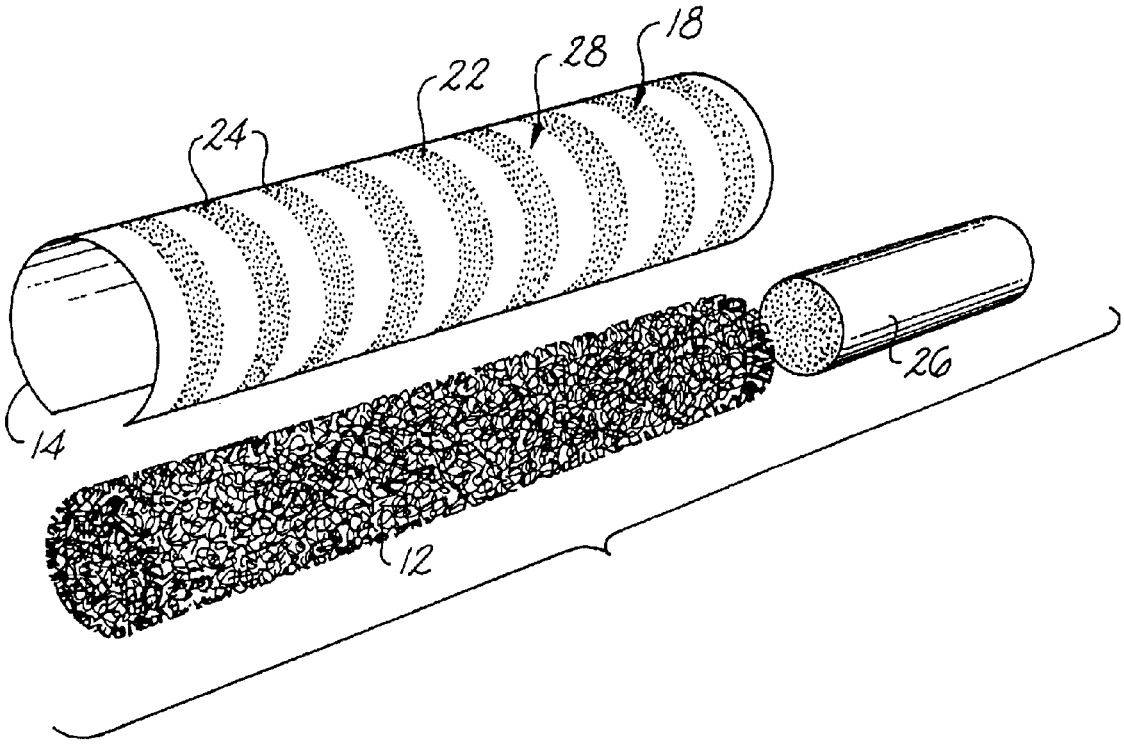

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-25 is confirmed.

* * * * *